US006705889B2

(12) United States Patent
Nishimoto

(10) Patent No.: US 6,705,889 B2
(45) Date of Patent: Mar. 16, 2004

(54) TERMINAL PROTECTING CAP

(75) Inventor: Chikao Nishimoto, Hiroshima (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/421,798

(22) Filed: Apr. 24, 2003

(65) Prior Publication Data

US 2003/0224638 A1 Dec. 4, 2003

(30) Foreign Application Priority Data

Apr. 25, 2002 (JP) ..... P2002-124305

(51) Int. Cl.[7] ..... H01R 13/52
(52) U.S. Cl. ..... 439/521; 439/522
(58) Field of Search ..... 439/521, 522, 439/901, 674, 677, 680, 488, 489

(56) References Cited

U.S. PATENT DOCUMENTS 5,346,407 A * 9/1994 Hood ..... 439/522
5,413,500 A * 5/1995 Tanaka ..... 439/521
5,439,759 A * 8/1995 Lippert et al. ..... 439/521
5,910,029 A * 6/1999 Siedlik et al. ..... 439/522

* cited by examiner

*Primary Examiner*—Tho D. Ta
(74) *Attorney, Agent, or Firm*—Sughrue Mion, PLLC

(57) ABSTRACT

A terminal protecting cap for containing a terminal fitting, includes a base member and a capping member. The base member includes a bottom face, on which the terminal fitting is placed, and a peripheral wall, extended from the bottom face so as to surround the terminal fitting. The capping member has a projecting portion, connected to the base member by a hinge, and rotating so as to cover an upper side of the base member. The projecting portion prevents a cover movement of the capping member with respect to the base member by abutting against the terminal fitting when the terminal fitting is placed on a improper position of the bottom face.

4 Claims, 5 Drawing Sheets

TERMINAL PROTECTING CAP

BACKGROUND OF THE INVENTION

The present invention relates to a terminal protecting cap, and more particularly to a terminal protecting cap which is capable of protecting the erroneous assembly of a plate-like terminal which is engaged with a bolt-and-nut type fixed terminal of such as an alternator or a starter motor of a vehicle, and of protecting a terminal portion thereof.

A connecting portion for an electric wire for supplying electricity to such as an alternator or a starter motor of a vehicle is so arranged that a plate-like terminal fixed to an end of an electric wire is fixed by being fastened by a bolt and a nut so as to prevent loosening due to vibrations occurring at the time of traveling. A terminal protecting cap is attached to such a terminal portion to maintain insulation and ensure protection from the outside.

As shown in FIG. 6, a related terminal protecting cap 1 includes a base member 2, a cap 3, and a wire cover 4, and is fabricated by injection molding a synthetic resin such as polypropylene.

The base member 2 consists of a terminal protecting portion 2*a* and a wire fixing portion 2*b*, which are formed continuously. A peripheral wall 2*c* is formed on three sides of the terminal protecting portion 2*a* excluding the wire fixing portion 2*b* side, such that peripheries of a bolt-and-nut type fixed terminal (not shown) disposed on such as the alternator or the starter motor are surrounded by the peripheral wall 2*c*.

A rib 2*d* is projectingly provided on an upper portion of the peripheral wall 2*c* horizontally toward the inner side. The arrangement provided is such that when a plate-like terminal 5 is built into the terminal protecting portion 2*a*, an electric contact portion 5*a* is built in below the rib 2*d*. Thus the electric contact portion 5*a* is positioned in advance inside the terminal protecting cap 1 in such a manner as to restrict the free movement of the electric contact portion 5*a*, i.e., the plate-like terminal 5 (particularly in a direction orthogonal to the plane of FIG. 6).

As a result, the efficiency with which the plate-like terminal 5 is assembled to the fixed terminal is improved, thereby making it possible to effect the operation efficiently. In addition, a retaining frame piece 2*e* is formed on the terminal protecting portion 2*a*, and is adapted to engage a retaining projection 3*a* (which will be described below) provided on the cap 3.

The wire fixing portion 2*b* for accommodating a wire connecting portion 5*b* to which one end of an electric wire 8 is secured. The wire fixing portion 2*b* is shaped like a spout and is formed continuously from the terminal protecting portion 2*a*. The width between inner side faces of the wire fixing portion 2*b* is set to a dimension substantially equal to the width of the wire connecting portion 5*b*.

A pair of projections 2*f* are formed on the rear end side of the wire fixing portion 2*b* in such a manner as to be oriented inwardly, and are adapted to position the plate-like terminal 5 (in the left-and-right direction in FIG. 6) by abutting against an end of the wire connecting portion 5*b*. Further, a retaining projection 2*g* is formed on a side face of the wire fixing portion 2*b*, and is adapted to engage a retaining frame piece 4*a* of the wire cover 4 which will be described later.

The cap 3 is a substantially box-shaped member which is formed continuously from the terminal protecting portion 2*a* of the base member 2 by a hinge 6 formed in the shape of a thin plate. The retaining projection 3*a* is formed in face-to-face relation to the retaining frame piece 2*e* of the terminal protecting portion 2*a*. Further, the arrangement provided is such that the cap 3 is rotated 180° by bending the hinge 6 to cover the upper side of the terminal protecting portion 2*a*, and is fixed by allowing the retaining projection 3*a* to engage the retaining frame piece 2*e*.

The wire cover 4 is a spout-shaped member, and covers the upper side of the wire fixing portion 2*b*. The wire cover 4 is formed continuously from a side of the wire fixing portion 2*b* by a hinge 9 formed in the shape of a thin plate. The retaining frame piece 4*a* is formed on a side of the wire cover 4 in face-to-face relation to the retaining projection 2*g*. The arrangement provided is such that when the upper side of the wire fixing portion 2*b* is covered by the wire cover 4 by bending this hinge 9, the wire cover 4 forms an accommodating chamber for accommodating the wire connecting portion 5*b* in cooperation with a spout-shaped portion of the wire fixing portion 2*b*.

The assembly of the plate-like terminal 5 into the terminal protecting cap 1 is effected as follows: In a state in which the cap 3 and the wire cover 4 are open, the wire connecting portion 5*b* is accommodated in the spout-shaped portion of the wire fixing portion 2*b*, and the electric contact portion 5*a* of the plate-like terminal 5 is positioned and incorporated below the rib 2*d* of the terminal protecting portion 2*a*.

As shown in FIG. 7, the hinge 9 is bent, the wire cover 4 is rotated 180° to cover the upper side of the wire fixing portion 2*b*, and the retaining projection 2*g* is engaged with the retaining frame piece 4*a*, thereby assembling the plate-like terminal 5 with the wire 8 secured thereto inside the terminal protecting cap 1.

Next, a bolt of the bolt-and-nut type (not shown) fixed terminal is inserted in a bolt hole 5*c* provided in the electric contact portion 5*a* of the plate-like terminal 5 assembled into the terminal protecting cap 1, and is fastened by a nut, thereby allowing the fixed terminal and the plate-like terminal 5 to be engaged.

Then, the hinge 6 is bent, the cap 3 is rotated 180° to cover the upper side of the terminal protecting portion 2*a* with the cap 3, and the retaining projection 3*a* is engaged with the retaining frame piece 2*e* to fix the cap 3, thereby completing the operation of connecting together the plate-like terminal 5 and the bolt-and-nut type fixed terminal.

With the related terminal protecting cap 1, even if the electric contact portion 5*a* is erroneously placed on the rib 2*d* at the time of incorporating the plate-like terminal 5 into the terminal protecting cap 1, as shown in FIGS. 8 and 9, and the plate-like terminal 5 is assembled as it is set in an inclined state, the cap 3 and the wire cover 4 can be closed without hindrance. Since there is no difference with the state persisting at the time of proper assembly, there is a problem in that an illusion can occur that proper assembly is performed.

In addition, also in an inspection process after the assembly, in the state in which the cap 3 and the wire cover 4 is closed, an abnormality in the fitting of the plate-like terminal 5 cannot be detected from the outside. Hence, to inspect the state of connection of the plate-like terminal 5, it is necessary to perform inspection by opening and closing the cap 3. Accordingly, there is a problem in that much inspection time is required.

Furthermore, if the plate-like terminal 5 is engaged with the bolt-and-nut type fixed terminal in the inclined state, electric connection between the fixed terminal and the plate-like terminal 5 becomes insufficient, and electric resistance becomes very large, thereby rendering the alternator or the starter motor inoperable. Even if the alternator or the starter can be operated, since the electric resistance between the fixed terminal and the plate-like terminal 5 is very large, there has been a malfunction such as the generation of abnormal heat occurring at the connecting portion.

SUMMARY OF THE INVENTION

It is therefore an object of the present invention to provide a terminal protecting cap which makes it impossible to close the cap and detect faulty assembly very easily in a case where the assembly of the plate-like terminal into the terminal protecting cap is incomplete, thereby making it possible to completely prevent faulty assembly.

In order to achieve the above object, according to the present invention, there is provided a terminal protecting cap for containing a terminal fitting, comprising:

a base member, including;

a bottom face, on which the terminal fitting is placed; and a peripheral wall, extended from the bottom face so as to surround the terminal fitting; and a capping member, having a projecting portion, connected to the base member by a hinge, and rotating so as to cover an upper side of the base member, wherein the projecting portion prevents a cover movement of the capping member with respect to the base member by abutting against the terminal fitting when the terminal fitting is placed on a improper position of the bottom face.

Preferably, the terminal fitting is a plate shape.

Preferably, the base member and the capping member have engagement portions respectively, and the engagement portions are engaged each other when the capping member is assembled to the base member.

In the above configuration, when the terminal fitting is not assembled at a proper position, the projecting portion provided on the capping member is adapted to abut against the terminal fitting. Therefore, the capping member cannot be closed, so that it is possible to detect an abnormality in the assembly of the terminal fitting very easily in an assembling process.

In addition, even when the operation has proceeded to an ensuing process, the abnormality can be detected from the outside by visually observing that the capping member is not closed. Consequently, it is possible to prevent the faulty operation of the alternator or the starter motor ascribable to faulty electric connection, and it is possible to avoid the generation of abnormal heat at a connecting portion of the terminal filling.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
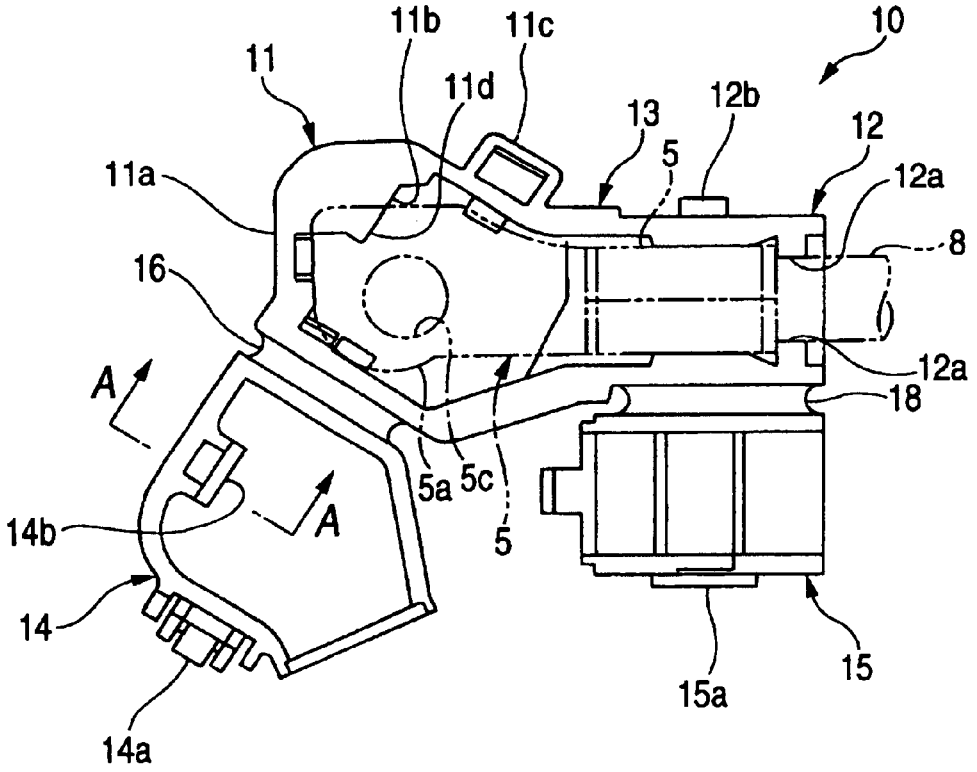
FIG. 1 is a plan view of a state in which a cap and a wire cover are opened, and illustrates an embodiment of the terminal protecting cap in accordance with the invention.
Figure 2:
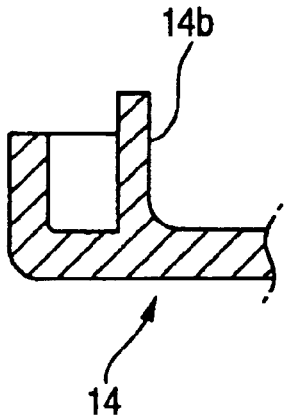
FIG. 2 is a cross-sectional view taken in the direction of arrows along line A—A in FIG. 1.
Figure 3:
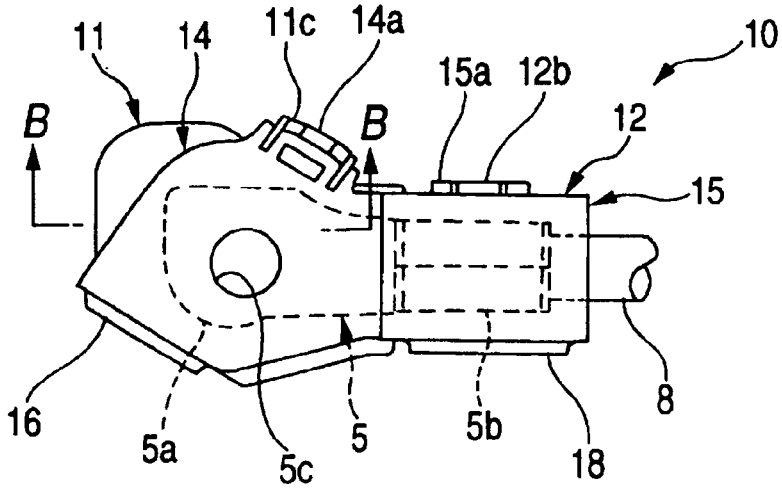
FIG. 3 is a plan view illustrating a state in which the cap and the wire cover in FIG. 1 are closed.
Figure 4:
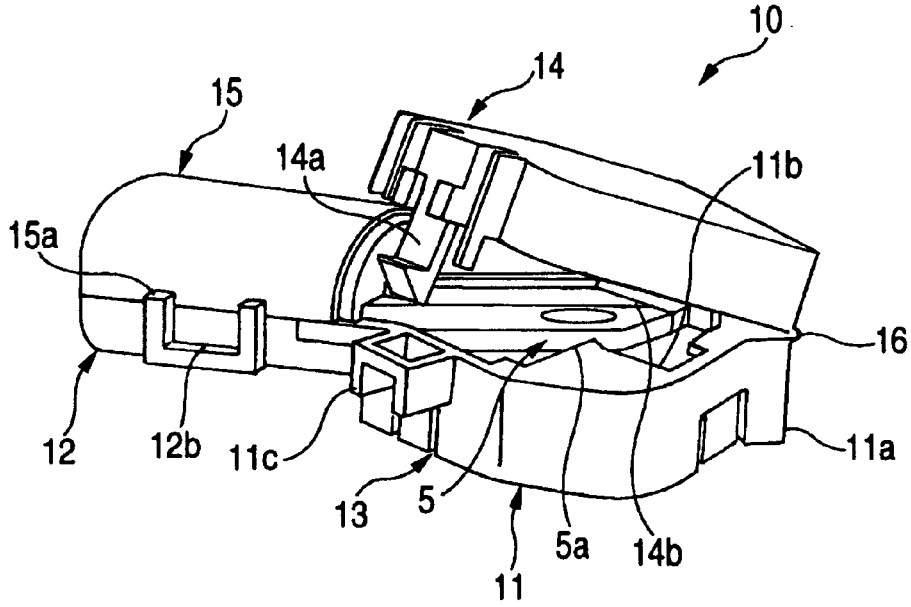
FIG. 4 is a perspective view illustrating a state in which a projecting portion of the cap abuts against a plate-like terminal which has been abnormally assembled.
Figure 5:
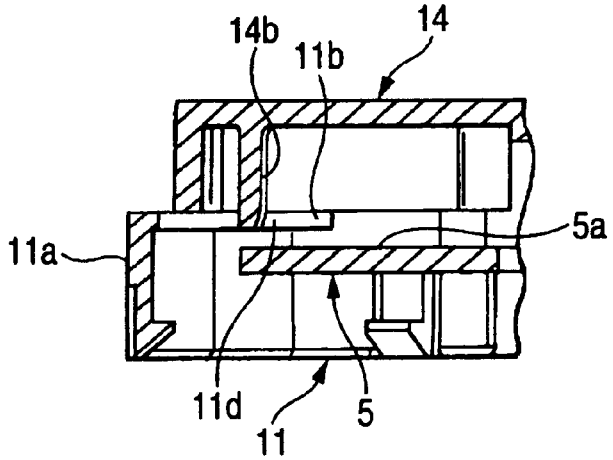
FIG. 5 is a cross-sectional view taken in the direction of arrows along line B—B in FIG. 3.
Figure 6:
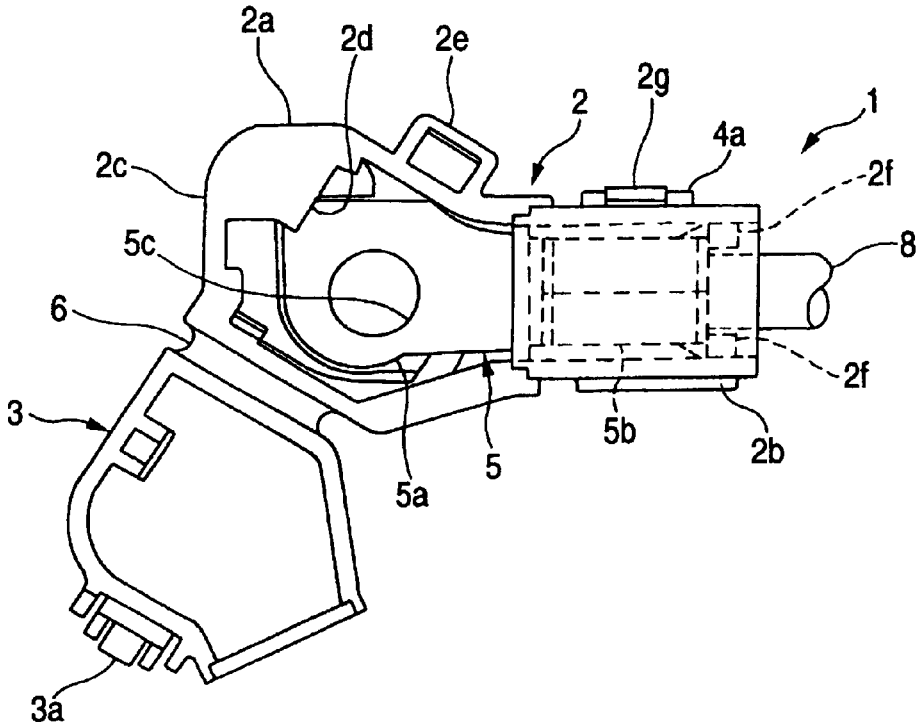
FIG. 6 is a plan view of a related terminal protecting cap.
Figure 7:
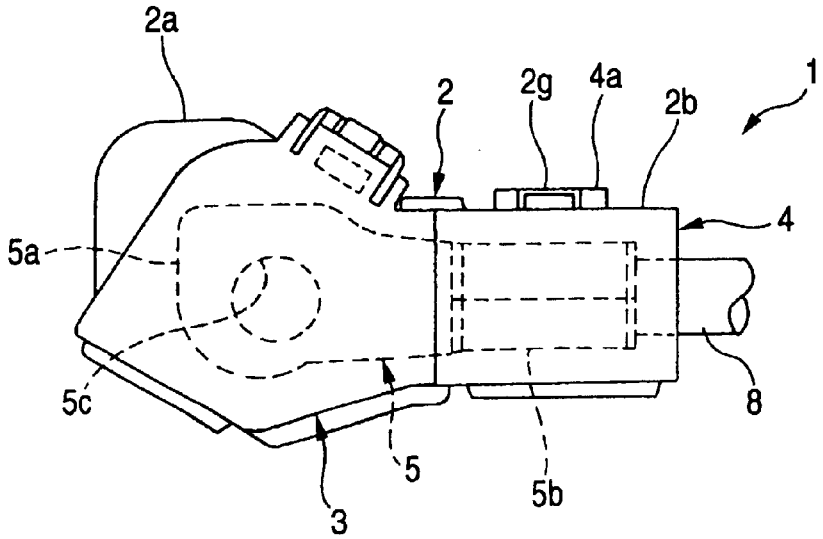
FIG. 7 is a plan view illustrating a state in which the cap and the wire cover in FIG. 6 are closed.

Referring now to FIGS. 1 to 5, a description will be given of a terminal protecting cap according to an embodiment of the invention. FIG. 1 is a plan view of a state in which a cap and a wire cover are opened, and illustrates the terminal protecting cap according to an embodiment of the invention. FIG. 2 is a cross-sectional view taken in the direction of arrows along line A—A in FIG. 1. FIG. 3 is a plan view illustrating a state in which the cap and the wire cover in FIG. 1 are closed. FIG. 4 is a perspective view illustrating a state in which a projecting portion of the cap abuts against a plate-like terminal which has been abnormally assembled. FIG. 5 is a cross-sectional view taken in the direction of arrows along line B—B in FIG. 3.

As shown in FIG. 1, a terminal protecting cap 10 according to this embodiment includes a base member 13 consisting of a terminal protecting portion 11 and a wire fixing portion 12, a cap 14, and a wire cover 15. The terminal protecting cap 10 is fabricated by injection molding a synthetic resin such as polypropylene. A peripheral wall 11*a* is formed on three sides of the terminal protecting portion 11 excluding the wire fixing portion 12 side, such that peripheries of a bolt-and-nut type fixed terminal (not shown) are surrounded by the peripheral wall 11*a*.

A rib 11*b* is projectingly provided on an upper portion of the peripheral wall 11*a* horizontally toward the inner side. The arrangement provided is such that when a plate-like terminal 5 is built into the terminal protecting portion 11, the rib 11*b* is located on the upper face side of an electric contact portion 5*a* of the plate-like terminal 5 to restrict the free movement of the electric contact portion 5*a*, thereby improving the efficiency with which the plate-like terminal 5 is assembled.

In addition, a retaining frame piece 11*c* is formed on the terminal protecting portion 11, and is adapted to engage a retaining projection 14*a* (which will be described below) provided on the cap 14.

The wire fixing portion 12 is for accommodating a wire connecting portion 5*b* to which one end of an electric wire 8 is secured. The wire fixing portion 12 is shaped like a spout and is formed continuously from the terminal protecting portion 11. The dimension between inner side faces of the spout-shaped wire fixing portion 12 is set to a dimension substantially equal to the width of the wire connecting portion 5*b*.

A pair of projections 12*a* are formed on the rear end side of the wire fixing portion 12 in such a manner as to be oriented inwardly, and are adapted to position the plate-like terminal 5 by abutting against an end of the wire connecting portion 5*b*. Further, a retaining projection 12*b* is formed on a side face of the wire fixing portion 12, and is adapted to engage a retaining frame piece 15*a* of the wire cover 15 which will be described later.

The cap 3 is a substantially box-shaped member which is formed continuously from the terminal protecting portion 11 of the base member 13 by a hinge 16 formed by a linear thin-walled portion. The arrangement provided is such that the cap 14 is rotatable by bending the hinge 16.

The retaining projection 14*a* is provided on a side face of the cap 14 in face-to-face relation to the retaining frame piece 11*c* of the terminal protecting portion 11, such that when the cap 14 is located on the upper side of the terminal protecting portion 11, the retaining projection 14*a* is engaged with the retaining frame piece 11*c* so as to fix the cap 14.

In addition, a projecting portion 14*b* is formed inside the cap 14 so as to have a slight gap between the projecting portion 14*b* and a side end face 11*d* of the rib 11*b* formed on the terminal protecting portion 11.

The wire cover 15 covers the upper side of the wire fixing portion 12, and is formed continuously from a side of the wire fixing portion 12 by a hinge 18 formed by a linear thin-walled portion.

The wire cover 15 is formed in the shape of a spout, and the retaining frame piece 15*a* is formed on a side of the wire cover 15 at a position opposing the retaining projection 12*b* of the wire fixing portion 12. The arrangement provided is such that when the upper side of the wire fixing portion 12 is covered by the wire cover 15 by bending this hinge 18 and rotating the wire cover 15 180°, the wire cover 15 forms an accommodating chamber for accommodating the wire connecting portion 5*b* in cooperation with a spout-shaped portion of the wire fixing portion 12.

A description will be given of the operation of the terminal protecting cap in accordance with this embodiment.

First, a description will be given of the assembly of the plate-like terminal 5 into the terminal protecting cap 10. In the state in which the cap 14 and the wire cover 15 are open as shown in FIG. 1, the electric contact portion 5*a* of the plate-like terminal 5 is located below the rib 11*b* of the terminal protecting portion 11 in such a manner as to slip in, as shown in FIG. 5, and the wire connecting portion 5*b* is accommodated and incorporated in the spout-shaped portion of the wire fixing portion 12.

The wire cover 15 is rotated 180° by bending the hinge 18, the wire fixing portion 12 is covered by the wire cover 15, and the retaining projection 12*b* is engaged with the retaining frame piece 15*a*. The wire 8 and the wire connecting portion 5*b* are clamped and fixed by the wire fixing portion 12 and the wire cover 15, thereby assembling plate-like terminal 5 into the terminal protecting cap 10.

Next, a bolt of the bolt-and-nut type (not shown) fixed terminal is inserted in a bolt hole 5*c* provided in the electric contact portion 5*a* of the plate-like terminal 5 assembled into the terminal protecting cap 10, and is fastened by a nut, thereby allowing the fixed terminal and the plate-like terminal 5 to be engaged.

Then, the hinge 16 is bent, the cap 14 is rotated 180° to cover the upper side of the terminal protecting portion 11. At this time, the projecting portion 14*b* provided in the cap 14 is disposed with a slight gap between the projecting portion 14*b* and the side end face 11*d* of the rib 11*b* of the terminal protecting portion 11, as shown in FIG. 5.

Accordingly, as shown in FIGS. 3 and 5, in the case where the plate-like terminal 5 is assembled at the proper position where it is located below the rib 11*b*, the cap 14 can be placed on the upper side of the protecting portion 11, and the retaining projection 14*a* and the retaining frame piece 11*c* are engaged, thereby completing the terminal connecting operation.

Figure 8:
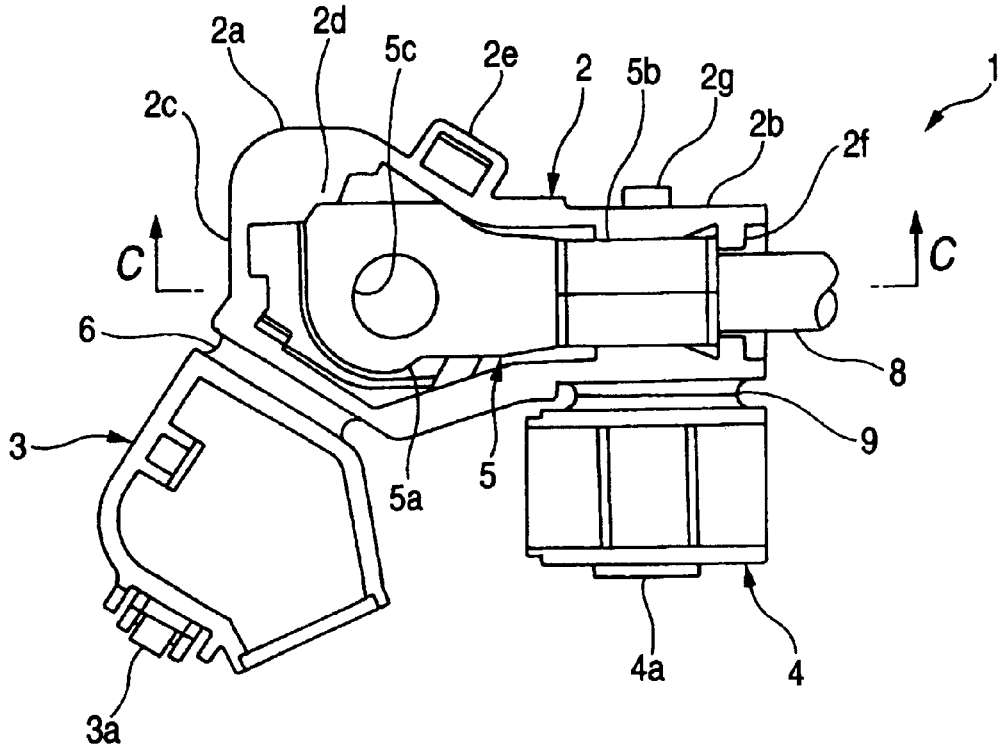
FIG. 8 is a plan view illustrating a state in which the plate-like terminal has been assembled by being erroneously placed on a rib of a terminal protecting portion.
Figure 9:
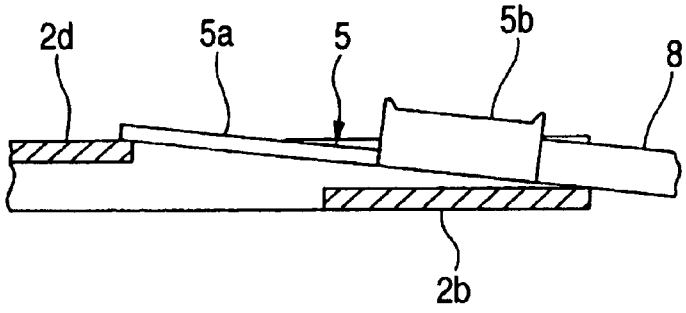
FIG. 9 is a cross-sectional view taken in the direction of arrows along line C—C in FIG. 8.

However, as shown in FIGS. 8 and 9, in a case where the plate-like terminal 5 is erroneously assembled in a state of being placed on the rib 11*b* at the time of incorporating the plate-like terminal 5 into the terminal protecting cap 10, the projecting portion 14*b* abuts against the electric contact portion 5*a* of the plate-like terminal 5 when the cap 14 is closed, as shown in FIG. 4, thereby hampering the rotation of the cap 14 and making it impossible to close the cap 14.

Consequently, it is possible to easily detect that the plate-like terminal 5 has not been assembled at the proper position. In addition, also in the inspection process and the like, it is possible to confirm the assembled state of the plate-like terminal 5 by visually observing whether the cap 14 is closed.

What is claimed is:

1. A terminal protecting cap for containing a terminal fitting, comprising:

a base member, including;

a bottom face, on which the terminal fitting is placed; and a peripheral wall, extended from the bottom face so as to surround the terminal fitting; and a capping member, having a projecting portion, connected to the base member by a hinge, and rotating so as to cover an upper side of the base member, wherein the projecting portion prevents a cover movement of the capping member with respect to the base member by abutting against the terminal fitting when the terminal fitting is placed on a improper position of the bottom face.

2. The terminal protecting cap as set forth in claim 1, wherein the terminal fitting is a plate shape.

3. The terminal protecting cap as set forth in claim 1, wherein the base member and the capping member have engagement portions respectively; and wherein the engagement portions are engaged each other when the capping member is assembled to the base member.

4. The terminal protecting cap as set forth in claim 1, wherein the base member has a positioning portion which positions the terminal fitting;

wherein the positioning portion has a receiving portion to receive the projecting portion so as not to interrupt the cover movement.

* * * * *